US005196644A

United States Patent [19]

Knight et al.

[11] Patent Number: 5,196,644

[45] Date of Patent: Mar. 23, 1993

[54] FUZING SYSTEMS FOR PROJECTILES

[75] Inventors: Leslie G. Knight, Sevenoaks; Trevor W. Waters, Petts Wood, both of England

[73] Assignee: The Secretary of State for Defence in Her Britannic Majesty's Government of the United Kingdom of Great Britain and Northern Ireland, London, England

[21] Appl. No.: 841,316

[22] Filed: Oct. 7, 1977

[51] Int. Cl.[5] ..... F42C 13/02

[52] U.S. Cl. ..... 102/213; 102/201

[58] Field of Search ..... 102/201, 213, 214, 215, 102/211; 244/3.13, 3.14, 3.15, 3.16

[56] References Cited

U.S. PATENT DOCUMENTS

| | | | |
|---|---|---|---|
| 2,557,949 | 6/1951 | Deloraine | 102/219 |
| 3,228,337 | 1/1966 | Grantham et al. | 102/201 |
| 3,485,461 | 12/1969 | Katsanis | 102/213 |
| 3,685,392 | 8/1972 | Platt | 102/201 |
| 3,698,811 | 10/1972 | Weil | 244/3.13 |
| 3,741,111 | 6/1973 | Brenner | 102/213 |
| 3,782,667 | 1/1974 | Miller, Jr. et al. | 244/3.13 |
| 4,014,482 | 3/1977 | Esker et al. | 244/3.13 |

FOREIGN PATENT DOCUMENTS

| | | |
|---|---|---|
| 1276081 | 6/1972 | United Kingdom . |
| 1298061 | 11/1972 | United Kingdom . |
| 1429941 | 3/1976 | United Kingdom . |

*Primary Examiner*—Charles T. Jordan

*Attorney, Agent, or Firm*—Cushman, Darby & Cushman

[57] ABSTRACT

An explosive projectile, eg an anti-tank shell, is fitted with a light-sensitive fuze enabling it to be detonated by a laser pulse transmitted at a time after firing the projectile determined by the pre-determined range to the target and the known velocity of the projectile. The fuze is located in the base of the shell (in addition to the usual impact fuze) with the light-signal detector, eg a photodiode, facing backwards. The detector is connected to the initiator via "fast" electronic circuitry so that the fuze is insensitive to "slow" or "DC" light signals such as the sun, searchlights etc. The laser beam is made slightly divergent to illuminate a suitable target area. The invention allows an anti-tank shell, normally loaded in the tank gun, to be used effectively against "soft" targets (troops, helicopters, etc) for which a direct hit is not necessary. The laser may be part of the gun range-finder system.

16 Claims, 1 Drawing Sheet

FUZING SYSTEMS FOR PROJECTILES

BACKGROUND OF THE INVENTION

This invention relates to fuzing systems for projectiles.

The present invention has one application in tank weapon systems, though not limited thereto. Normally, the ammunition carried by a tank for use in its main gun is primarily intended to destroy other tanks and is therefore designed to penetrate, or otherwise overcome, thick armour plating. Such ammunition may be solid shot, or may be various types of explosive rounds, e.g. shaped-charge devices, fitted with impact fuzes. For some other kinds of targets, however, such as "thin-skinned" vehicles, troops in the open, or low-flying helicopters, a direct hit is not essential and is sufficient for a projectile to explode in the air in the vicinity of the target to inflict adequate damage or casualties. Clearly also, the chances of destroying or damaging such "soft" targets are greater if a direct hit is not required.

Systems which cause a projectile to explode in the vicinity of a target are known, e.g. shells fitted with clockwork fuzes which operate a predetermined time after leaving the gun, the time being set manually in accordance with the known velocity of the projectile and the predetermined range to the target. However such rounds are unsuitable for use with tanks, in which the gun is usually kept loaded ready for immediate use and the fuze mechanism is thus inaccessible. Proximity fuzes are also known, e.g. incorporating a Doppler radar system, but although suitable for normal anti-aircraft use, proximity fuzes are unsuitable for use near the ground because they are liable to be triggered by objects other than the target, e.g. by trees or the ground itself. It is one object of the present invention to provide an alternative fuzing system more suitable for use by tanks against "soft" targets.

SUMMARY OF THE INVENTION

According to the present invention a fuzing system for an explosive projectile comprises:

fuze means adapted to be incorporated in the projectile and comprising a light-signal detector arranged to initiate the explosion of the projectile upon receipt of a light-signal by the detector.

and means for transmitting, at a time after firing the projectile related to the known velocity of the projectile and the predetermined range to a target, a said light-signal receivable by said detector such that said explosion occurs at least approximately when the projectile reaches the target.

The present invention also provides, for use in a system as aforesaid, fuze means adapted to be incorporated in a projectile and comprising a light-signal detector arranged to initiate the explosion of the projectile upon receipt of a light-signal by the detector.

Additionally, the present invention provides, for use in a system as aforesaid, means for transmitting a light-signal at a time after firing a projectile related to the known velocity of the projectile and the predetermined range to a target whereby the light-signal may be received by a detector included in fuze means incorporated in the projectile and thereby cause the projectile to explode at least approximately when it reaches the target.

The means for transmitting the light-signal may comprise means, operable by a signal produced by firing the projectile, for generating said light-signal at the aforesaid time after firing.

In the present Specification the term "projectile" includes those propelled by an external charge, such as shells fired from guns, and missiles which carry their own propellant, such as rockets, together with rounds which combine both these propellant systems.

The light signal is preferably visible light and is preferably a light-pulse derived from a laser. The laser may form part of a laser range-finder provided for aiming the projectile-launcher, e.g. for setting the elevation of a tank gun, and the system may comprise means for combining the thus-determined range with the known velocity of the projectile to produce a signal which causes the laser to emit a light-pulse at the appropriate time after the firing of the projectile to explode the latter when it reaches the target.

A known form of laser range-finder operates by directing a very short pulse of laser light on to a visible target, and timing the interval between the emission of the pulse and its reflection from the target, i.e. it employs the radar principle but uses visible instead of radio-frequency radiation. One advantage of using a laser as the light-source in such a range-finder is the ability of a laser to produce very short (nanosecond) pulses of high-intensity light in a narrow, substantially parallel-sided, beam. The shape of this beam may, however, be unsuitable for the additional function of subsequently providing the aforesaid light-signal for initiating the explosion of the projectile, since the detector on the projectile is necessarily of small area and, when in the vicinity of the target, may be outside the narrow beam. Preferably, therefore, means are provided, such as a suitable lens arrangement removably insertable in the laser beam, for causing the light-signal beam to be divergent. Preferably the beam divergence, e.g. the focal length of the lens arrangement, is controlled in relation to the range to maintain an illuminated area of approximately constant size over the ranges of interest, e.g. a servo-operated "zoom" lens controlled by the determined range may be used.

It is not however essential that the laser which provides the light-signal for exploding the projectile should be a laser incorporated in a range-finder. A separate laser may be provided for the fuzing function, in which case the beam-diverging means may be permanently located in its beam. Also, the range can be determined other than by a laser range-finder.

The fuze means incorporated in the projectile may be additional to the impact or other fuzes incorporated therein. Indeed it is a principal advantage of the invention, as explained earlier, that it enables an impact-fuzed explosive round, already loaded into a tank gun, to be fired and detonated adjacent a target without impacting thereon. The fuze means may be insertable in the base of the shell or other projectile and may comprise a rearward-facing photo-sensitive detector which produces an electrical signal on receipt of the light-signal, and an electronic signal-processing channel arranged to cause receipt of such a signal to initiate the explosion of the shell or other projectile. The channel is preferable arranged to pass only fast-rising pulses, which characterize laser pulses, so that the explosion is not initiated by relatively slow-rising or "DC" light signals such as may be produced by the sun, searchlights, fires fires etc. The detector may be located behind a transparent window which serves to protect it, and the fuze interior, from the propellant gases in the barrel of the gun or other launcher. The detector or window may also be protected by a shield which detaches from the projectile when it leaves the barrel. The detector may be a photo pin diode or avalanche diode.

For engaging direct targets, i.e. those within optical range of the launcher, as is usual with tanks, the means for transmitting the light-signal will normally be located adjacent the launcher, e.g. aboard the tank. However the invention is also applicable to engaging indirect targets, i.e. target not visible from the launcher, which fires on range instructions received from an observation point, normally forward of the launcher, located to view the target. In such situations the means for transmitting the light-signal may be located at the observation point, a link being provided to transmit from the launcher such data, including the instant of firing the projectile, as is required to correctly time the light-signal.

DESCRIPTION OF THE DRAWINGS

To enable the nature of the present invention to be more readily understood, attention is directed, by way of example, to the accompanying drawings wherein.

DESCRIPTION OF PREFERRED EMBODIMENT

Figure 1:
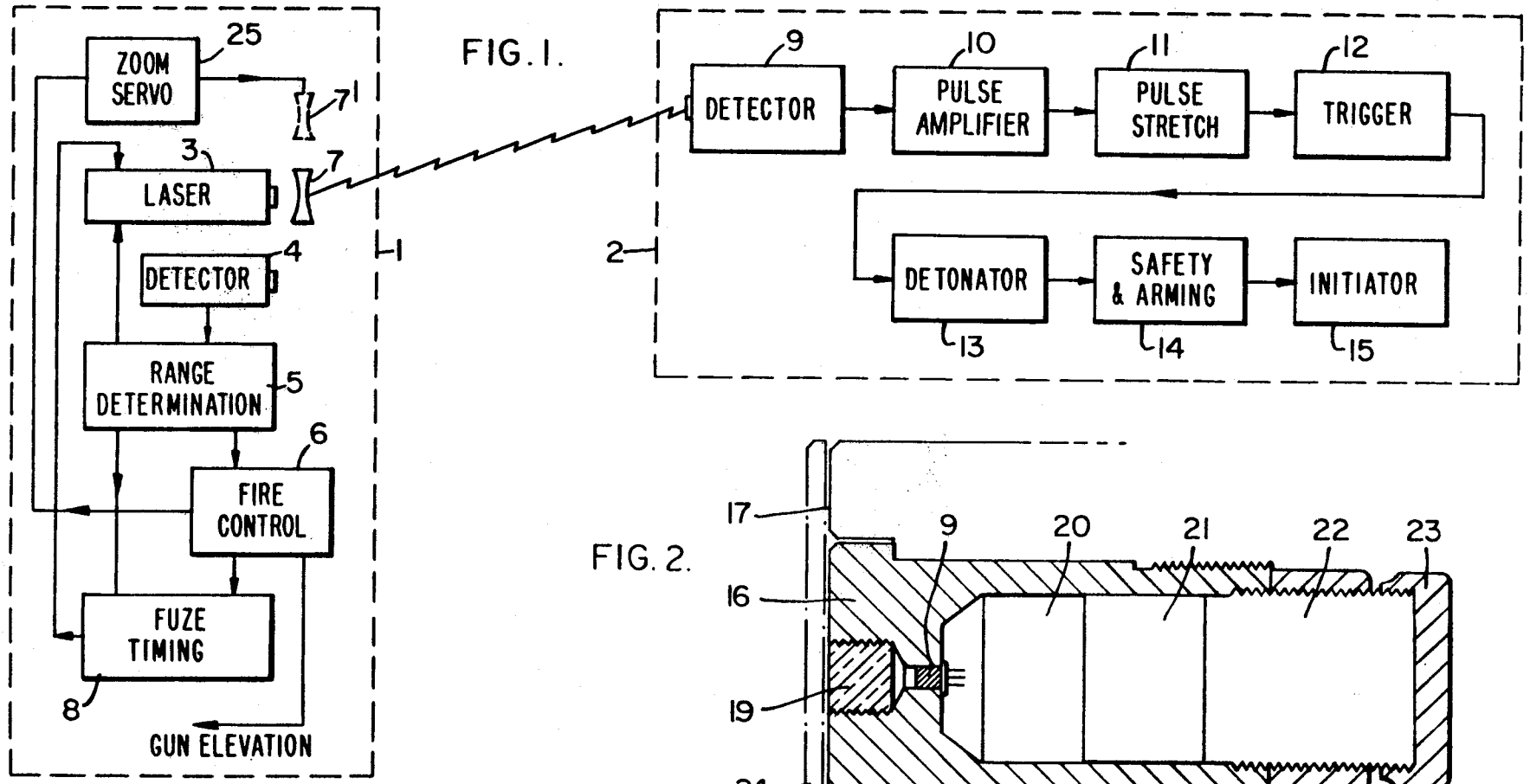
FIG. 1 is a block schematic diagram of a fuzing system embodying the present invention and suitable for use in a tank.
Figure 2:
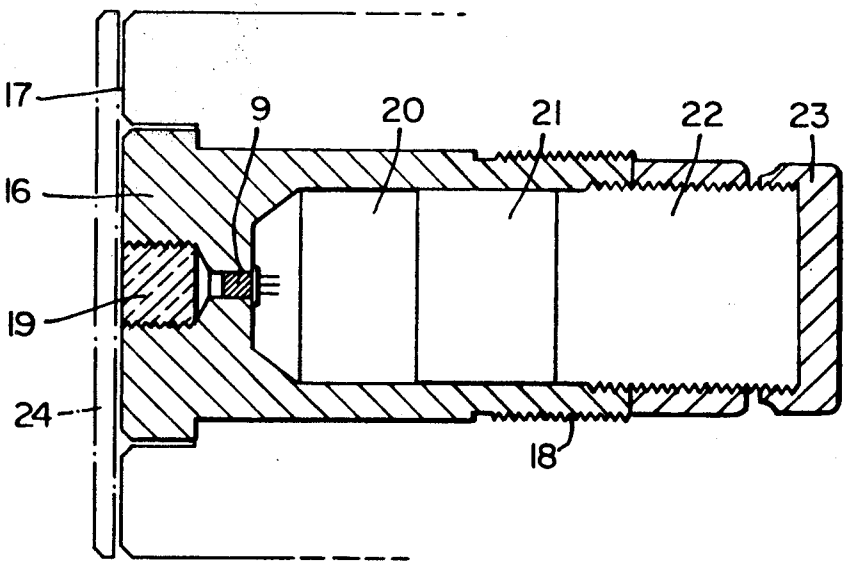
FIG. 2 is a vertical section of a fuze in accordance with the present invention suitable for incorporation in a tank shell.

Referring to FIG. 1, the units within the interrupted line 1 are mounted aboard the tank and the units within the interrupted line 2 are located within the fuze of the shell fired by the tank gun, e.g. the fuze shown in FIG. 2.

Within line 1 are shown a laser pulse transmitter 3, suitably of the neodymium glass type, and a detector 4 for receiving the laser light-pulse reflected from a target (not shown). The time-interval between transmission of a laser pulse (initiated by the tank gunner) and its receipt is measured by a unit 5 which thereby determines the range to the target. This data is fed to a fire-control unit 6 and is used to control the elevation of the gun barrel (not shown). When used for range-finding, the diverging lens 7 is located at 7', out of the laser beam. The arrangement described so far, neglecting the lens 7, is a known one.

In accordance with the present invention the target range data is also fed to a fuze timing unit 8. Also stored in unit 8 is data relating to the velocities of the type or types of explosive ammunition carried by the tank, and how these velocities vary with range and conditions. The tank gunner can set unit 8 to select the data appropriate to the particular type of ammunition in use. Unit 8 also receives a signal from unit 6 at the instant the gun is fired, and computes from the aforesaid range and velocity data how long thereafter a shell will reach the target. At that instant unit 8 generates a signal which causes laser 3 to transmit a further pulse. It is also arranged that between taking the range and firing the gun the lens 7 is moved mechanically, e.g. electromagnetically, into the laser beam as shown, under the control of unit 6. The further pulse transmitted by the laser therefore has a beam which is not substantially parallel-sided but slightly divergent, so as to illuminate a target area within which the shell may pass.

Typically, the maximum lethal radius of the fragments from an explosive shell may be about 20 meters, and the beam should therefore illuminate a target area of approximately this size. Hence at a range of, say 4000 meters, the divergent beam may suitably subtend a solid angle of about 10 m rad, as compared with a non-divergent beam of about 0.1 m rad.

With a fixed angular divergence, the size of the illuminated target area will depend on the range, so that if the divergence is optimized for short ranges, the target area may be so large at longer ranges as to spread the laser power unduly and make reception of the light-signal difficult. Similarly, if the angular divergence is optimized for longer ranges, it may illuminate an insufficient area at short ranges. It is therefore preferred to make the beam-divergence adjustable to match the range and thereby maintain the illuminated area at an approximately constant optimum size. This is achieved by making the lens 7 in FIG. 1 a "zoom" lens servo-operated by a unit 25 which is controlled by the fire control unit 6, i.e. in addition to unit 6 causing the lens 7 to be introduced into the beam, at the same time it causes the focal length to be adjusted in accordance with the range.

It will be appreciated that rather than moving lens 7 between two positions, as shown diagrammatically in FIG. 1, in practice the lens position can be fixed and the lens inserted into the laser beam by moving other optical elements such as prisms which direct the laser beam through it.

Considering now the units within the shell fuze, the divergent beam from laser 3 is received by a rearward-facing detector 9, suitably a photo PIN or avalanche diode. The electrical pulse thus produced is amplified by a pulse-amplifier 10 having a high-pass frequency response so that detector outputs resulting from continuous ("DC") light inputs, or light inputs having relatively slow rise-times, are rejected. Thus an effective output is obtained from amplifier 10 only when the light-signal has the fast rise-time characteristic of a laser pulse.

The short output pulse produced by amplifier 10 is stretched by a pulse-stretcher 11 to provide a trigger pulse for trigger circuit 12. The output of the latter is fed to operate a detonator 13, safety and arming unit 14 and chemical-energy pellet initiator 15, in a conventional manner.

FIG. 2 shows the mechanical arrangement of the shell fuze. It comprises a metal body 16 which screws into the base 17 of the shell by means of threads 18. Within the body is mounted the photo-detector 9 (a photo-diode), protected by a thick transparent plastics window 19. Beyond detector 9 is a compartment 20 which contains the electronic circuits 10, 11 and 12 of FIG. 1. Compartment 21 contains the fuze energizer which provides the electrical power supply for the fuze circuits etc, and suitably comprises, as is conventional, a storage cell whose electrolyte is released when the shell is fired. Compartment 22 contains the conventional units 13, 14 and 15 of FIG. 1, most of its volume being occupied by the initiator pellet. When the latter explodes, a shock-wave is propagated through end-cap 23 to detonate the main charge of the shell (not shown) in the conventional way.

The thick window 19 protects the detector 9 from the pressure of, and damage by, the propellant gases until the shell leaves the barrel, and also seals the fuze from entry by these gases. To provide further protection during firing, the base may be protected by a metal shielding plate (indicated at 24) arranged to become detached from the shell after the latter leaves the barrel.

In a modified form of the described embodiment the laser 3 is used only for range-finding, and a separate second laser (not shown) provides the light-signal for operating the fuze. With this arrangement the lens 7 can be permanently located in the beam of the second laser, so that relative movement of the beam and lens is not required.

The effective range of the system will depend on the visibility. By way of example, assuming a 8 MW Nd laser, the beam divergence controlled as described to illuminate a target area of 20 m radius, a PIN photo-diode having a sensitivity of about 0.1 $\mu A/mW/m^2$ at the laser wavelength of $1.064\mu$, and a lower limit of photo-diode current for detonation of 5 $\mu A$, the maximum range in poor visibility ($\sigma$=atmospheric extinction coefficient$=8\times10^{-4}m^{-1}$) will be about 3000 m, calculated from the equation $$\text{power reaching target area} = P_T e^{-\sigma R},$$

where $P_T$ is the transmitted power and R is the range. In good visibility (e.g. $\sigma=8\times10^{-5}m^{-1}$), the maximum range will be correspondingly increased.

Assuming a 5 $\mu A$ lower limit of photo-diode current for detonation, amplifier 10 may suitably have a current gain of about 1000 for a 20 nsec photo-diode pulse, and pulse-stretcher 11 may stretch the 5 mA amplified pulse to a 20 $\mu$sec trigger pulse for circuit 12.

Although described with reference to its use in tank weapon systems, the invention is not limited to such use but can be applied to other gun and missile systems.

We claim:

1. A fuzing system for an explosive projectile comprising: fuze means adapted to be incorporated in the projectile and comprising a light-signal detector arranged to initiate the explosion upon receipt of a light-signal by the detector; and means operable by a signal produced when firing the projectile for transmitting, at a time after firing the projectile related to the known velocity of the projectile and the predetermined range to a target, a said light-signal receivable by said detector so that said explosion occurs at least approximately when the projectile reaches the target.

2. A system as claimed in claim 1 wherein the light-signal is a light-pulse transmitted as a beam from a laser.

3. A system as claimed in claim 2 wherein the laser forms part of a laser range-finder provided for aiming a launcher for said projectile.

4. A system as claimed in claim 3 comprising means for combining the thus-determined range with the known velocity of the projectile to produce a signal which causes the laser to emit a light-pulse at the appropriate time after the firing of the projectile to explode the latter when it reaches the target.

5. A system as claimed in claim 4 comprising means removably insertable in the laser beam after determining the range for causing said light-pulse beam to be divergent.

6. A system as claimed in claim 2 wherein the laser is provided solely to produce said light-signal and comprising means for causing the beam from said laser to be divergent.

7. A system as claimed in claim 1 wherein the fuze means is adapted to be located in the rear end of the projectile and comprises a rearward-facing photo-sensitive detector, e.g. a photo diode, which produces an electrical signal on receipt of the light-signal and an electronic signal-processing channel arranged to cause receipt of such a signal to initiate the explosion of the projectile.

8. A system as claimed in claim 7 wherein the channel is arranged to pass only fast-rising pulses in order to prevent initiation by relatively slow-rising or "DC" light signals.

9. A system as claimed in claim 7 wherein the rear end of the projectile is protected by a shield arranged to detach from the projectile after firing.

10. A system as claimed in claim 5 wherein the means for producing beam divergence is controlled by the determined range, e.g. is a zoom lens, to maintain an illuminated area of approximately constant size over the ranges of interest.

11. A system as claimed in claim 1 for use in a tank having a gun and wherein the projectile is fired from said gun, said projectile being an explosive anti-tank projectile having an impact fuse.

12. For use in a system as claimed in claim 1, fuze means adapted to be incorporated in a projectile and comprising a light-signal detector arranged to initiate the explosion of the projectile upon receipt of a light-signal by the detector.

13. For use in a system as claimed in claim 1, means for transmitting a light-signal at a time after firing a projectile related to the known velocity of the projectile and the predetermined range to a target so that the light-signal may be received by a detector included in fuze means incorporated in the projectile and thereby cause the projectile to explode at least approximately when it reaches the target.

14. A system as claimed in claim 6 wherein the means for producing beam divergence is controlled by the determined range, e.g. is a zoom lens, to maintain an illuminated area of approximately constant size over the ranges of interest.

15. For use in a system as claimed in claim 1, a projectile incorporating fuze means comprising a light-signal detector arranged to initiate the explosion of the projectile upon receipt of a light-signal by the detector.

16. For use in a system as claimed in claim 11, an explosive anti-tank projectile having an impact fuze and incorporating further fuze means comprising a rearward-facing light-signal detector arranged to initiate the explosion of the projectile upon receipt of a light-signal by the detector.

* * * * *